US009724719B2

(12) United States Patent
McCune et al.

(10) Patent No.: US 9,724,719 B2
(45) Date of Patent: Aug. 8, 2017

(54) SELF-CLEANING SPRAY VALVE ASSEMBLY

(71) Applicant: L & P PROPERTY MANAGEMENT COMPANY, South Gage, CA (US)

(72) Inventors: Richard L. McCune, Carthage, MO (US); Matthew Smallwood, Carthage, MO (US); Terrance L Myers, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 948 days.

(21) Appl. No.: 13/672,808

(22) Filed: Nov. 9, 2012

(65) Prior Publication Data

US 2014/0131463 A1 May 15, 2014

(51) Int. Cl.
*B05B 12/00* (2006.01)
*B05B 15/02* (2006.01)
(Continued)

(52) U.S. Cl.
CPC ..... *B05B 15/025* (2013.01); *B05B 12/02* (2013.01); *B05B 12/06* (2013.01); *B05B 7/0807* (2013.01)

(58) Field of Classification Search
CPC ..... Y10T 137/7737; B05B 7/1209
(Continued)

(56) References Cited

U.S. PATENT DOCUMENTS 3,403,695 A 10/1968 Hopkins
5,017,409 A 5/1991 Bok
(Continued)

FOREIGN PATENT DOCUMENTS

EP 0588054 A1 3/1994
EP 2392408 A1 12/2011
(Continued)

OTHER PUBLICATIONS

International Search Report with Written Opinion mailed Apr. 4, 2014 in PCT Application No. PCT/US2013/069196, 14 pages.
Non-Final Office Action dated Jul. 17, 2015 in U.S. Appl. No. 13/800,439, 7 pages.
(Continued)

*Primary Examiner* — Arthur O Hall
*Assistant Examiner* — Viet Le
(74) *Attorney, Agent, or Firm* — Shook, Hardy & Bacon L.L.P.

(57) ABSTRACT

Systems and methods for producing consistent spray patterns and for diminishing clogging experienced when applying spray adhesive from a spray gun are provided. One system includes an automatic non-atomizing spray valve operably coupled to a first and second flow valve. The spray and flow valves are electronically controlled using logic running on a processing unit. The logic is programmed to carry out a spray cycle that involves dispensing a first liquid from the spray valve (first phase) and then dispensing a second liquid through the same spray valve (second phase). Because the first liquid (e.g., water-based adhesive) has the potential to clog a nozzle of the spray valve, a short burst of the second liquid (e.g., cleaning fluid) is introduced to prevent the nozzle from clogging. The spray valve is configured as a pulse width modulated spray gun to further reduce clogging and to generate an evenly distributed spray pattern.

10 Claims, 3 Drawing Sheets

(51) Int. Cl.
*B05B 12/02* (2006.01)
*B05B 12/06* (2006.01)
*B05B 7/08* (2006.01)

(58) Field of Classification Search
USPC ..... 222/145.2; 239/112
See application file for complete search history.

(56) References Cited

U.S. PATENT DOCUMENTS 5,421,921 A 6/1995 Gill et al.
5,429,840 A 7/1995 Raterman et al.
5,941,456 A 8/1999 Waryu et al.
6,037,009 A 3/2000 Clare et al.
6,193,167 B1 * 2/2001 Sunde ..... B05B 12/14 239/112
6,325,853 B1 12/2001 Hogan et al.
6,602,554 B1 8/2003 Kwok
6,936,125 B2 8/2005 Harris
6,978,978 B2 * 12/2005 Near ..... F16K 31/0675 251/129.05
7,717,059 B2 5/2010 Wanthal et al.
2010/0065130 A1 * 3/2010 Swab ..... B05B 7/0408 137/170.1
2010/0193601 A1 8/2010 Nabeshima

FOREIGN PATENT DOCUMENTS

GB 2323802 A 10/1998
WO 9112088 A1 8/1991

OTHER PUBLICATIONS

Non-Final Office Action dated Nov. 20, 2015 in U.S. Appl. No. 13/800,439, 20 pages.
Extended European Search Report dated Jun. 29, 2016 for European Patent Application No. 13853125.6, 9 pages.
Final Office Action dated May 26, 2016 in U.S. Appl. No. 13/800,439, 24 pages.
Notice of Allowance dated Oct. 5, 2016 in U.S. Appl. No. 13/800,439, 10 pages.

* cited by examiner

SELF-CLEANING SPRAY VALVE ASSEMBLY

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

When assembling two or more articles (e.g., assembling fabric to foam in the industrial field of furniture manufacturing) using adhesion, operators have increasingly relied upon applying fast-acting spray adhesives. Often, at least one bay of an assembly line will include a spray gun that applies the spray adhesive to the article(s) for subsequent adhesion. The spray gun is equipped to apply the spray adhesive in a manner that is more uniform and more rapid that traditional liquid adhesives (e.g., hot-glue gun). Thus, these spray adhesives serve as both an effective glue-type material for joining articles together while, at the same time, allow for efficiencies during fabrication.

Typically, during application, the spray guns atomize the spray adhesive to attain sufficient coverage of the article(s) being handled on the assembly line. Various problems exist with these atomizing-type spray guns. Initially, atomizing-type spray guns create an inconsistent application of the spray adhesive on the intended article(s), as well as "fog up," in which misdirected, airborne, spray adhesive comes into contact with the assembly-line bay, the operator, assembly tools, and other items that are not intended to receive the spray adhesive. This situation of fog up generally precipitates from the atomizing-type spray gun's inherent lack of control in both spray-pattern consistency and the amount of adhesive being sprayed. Further, using fast-dry spray adhesive in an atomizing-type spray guns have a high potential to clog after a minimal number of bursts. Clogging is generally due to the combination of the requirement for a narrow channel within the nozzle of the atomizing-type spray gun and the natural tendency for the spray adhesive to cling to any surface it encounters. Accordingly, embodiments of the present invention introduce technology for resolving the above-mentioned issues conventionally experienced when applying spray adhesive from a spray gun.

BRIEF SUMMARY OF THE INVENTION

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

The embodiments of the present invention relate broadly to innovative systems and methods for resolving the inefficiencies (e.g., inconsistent spray pattern and amount, clogging, and fog-up) experienced when applying spray adhesive from a conventional spray gun.

The innovative systems include an automatic spray valve assembly, which includes flow valves (e.g., a first and second flow valve) operably coupled to a spray valve. As used herein, the phrase "spray valve" is meant to broadly encompass any spraying mechanism or apparatus that disperses/streams a fluid onto an article or underlying surface across an airspace. For example, the spray valve may be an atomizing spray gun, a non-atomizing spray gun, an electronically controlled pulse width modulated (PWM) spray gun, any other type of spray valve known in the relevant field, or any combination thereof. The spray valve assembly may be either compiled from separate, individual valves or fabricated as one single valve to operate in unison. Further, the spray valve may be electronically controlled using logic running on a processing unit.

The innovative methods, which are typically enforced by the logic residing on the processing unit, include a spray cycle that generally involves spraying a first liquid from the spray valve (first phase) and then spraying a second liquid through the same spray valve (second phase). The first liquid (e.g., water-based adhesive) has the potential to clog the nozzle of the spray valve. Thus, upon completion of the first phase of the spray cycle (e.g., spraying the specified amount of the first liquid), a short burst of a second liquid (e.g., cleaning fluid, hydrogen peroxide, or water) is introduced to the spray valve to clean out the nozzle and prevent it from clogging. This short burst of the second liquid is included within the second phase of the spray cycle. It should be noted that a second liquid is employed within the second phase to clean the nozzle, as opposed to compressed air. This is because, when used as a clean-out material, compressed air has a tendency to react with the first liquid (e.g., spray adhesive) causing deposits of the first liquid to dry up on the nozzle and to clog the spray valve.

In an exemplary embodiment, the first phase involves the processing unit electronically controlling a first flow valve to allow a predetermined volume of the first liquid to enter an inlet of the spray valve. Upon ceasing the flow of the first liquid to the spray valve, using the first flow valve, the second phase involves the processing unit electronically controlling a second flow valve to allow a predetermined volume of the second liquid to enter another inlet of the spray valve. Subsequently, this predetermined volume of the second liquid is automatically expelled from the spray valve as a short burst (e.g., approximately one quarter of a second), thereby keeping the nozzle of the spray valve clear of adhesive. As discussed more fully below, the first and second flow valves are located upstream of the spray valve (within the spray valve assembly) and may be electronically controlled (e.g., solenoid-controlled pneumatic valve) or manually controlled (e.g., handheld dispensing valve).

In other embodiments, there exists the spray valve (or primary spray valve) and an ancillary spray valve that function in cooperation to generate a complete spray adhesive. The primary spray valve, as discussed above, projects a first liquid from its nozzle. In this scenario, the first liquid represents a form of non-activated glue. The ancillary spray valve projects a third liquid from its nozzle, where the third liquid represents a form of activator fluid. The nozzles of the primary and ancillary spray valves are arranged (positioned and orientated) such that the separately aimed streams of the non-activated glue and the activator fluid meet before or upon the article being targeted.

In yet another embodiment, the primary spray valve and/or the ancillary spray valve represent an PWM spray gun for dispensing non-activated glue and/or activator fluid, respectively. The PWM spray gun is configured to control the rate and amounts of liquid being deposited on the article passing beneath the separate streams. Further, the PWM spray gun is capable of producing a non-atomized dispersion of the spray adhesive, which overcomes the disadvantages inherent within the prior practices of the atomizing-type spray guns (consistency of spray) and hot-glue guns (time and expense of maintaining heated glue within distribution lines).

BRIEF DESCRIPTION OF THE SEVERAL VIEWS OF THE DRAWINGS

In the accompanying drawings, which form a part of the specification and which are to be read in conjunction therewith, and in which like reference numerals are used to indicate like parts in the various views.

DETAILED DESCRIPTION OF THE INVENTION

Generally, embodiments of the present invention introduce technology for providing an automatic spray valve assembly ("assembly") that functions to dispense a first fluid (e.g., liquid adhesive) and a second fluid (e.g., liquid cleaner) consecutively, where the assembly includes flow valves and a spray valve (e.g., pulse width modulated (PWM) spray gun, non-atomizing spray gun, atomizing spray gun, and a non-PWM spray gun) that are either connected as individual valves or combined into one unit. This technology, in embodiments, allows for generating an evenly distributed spray pattern on a surface of a subject article as well as diminishing clogging within a nozzle of the spray valve. Further, these embodiments of this technology provide operational efficiencies and cost savings over such prior practices as handheld, atomizing spray guns and hot-glue guns that are fed by lines of heated glue.

Figure 1:
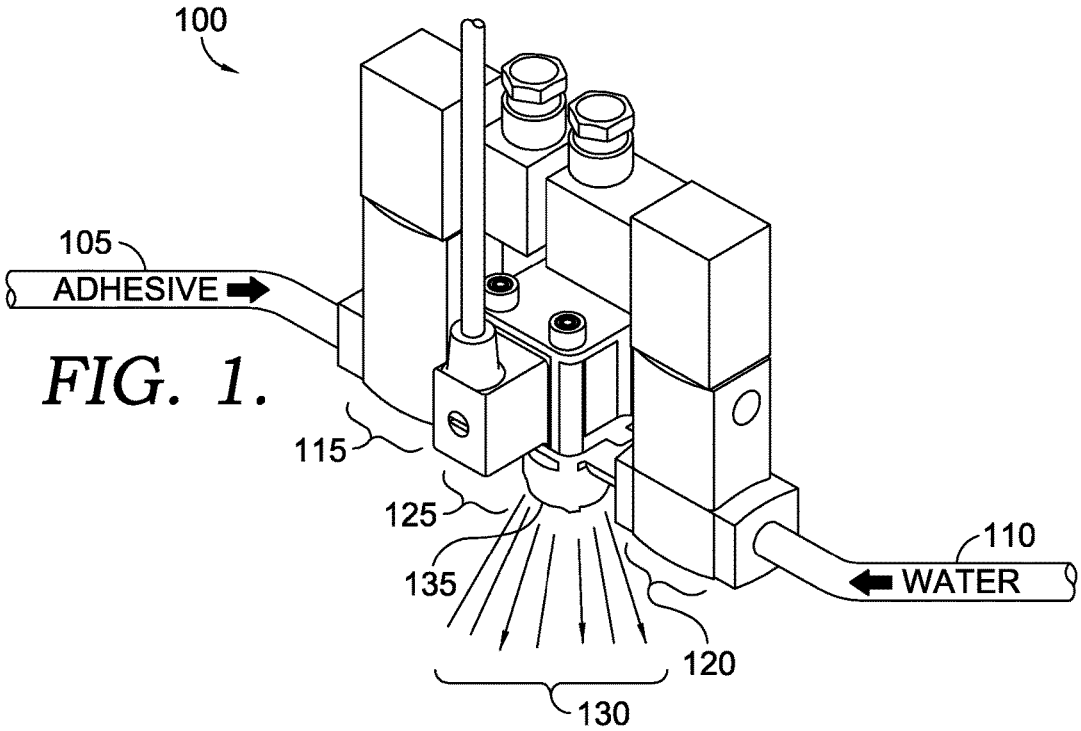
FIG. 1 is a diagrammatic perspective view of a spray valve assembly in operation, in accordance with an embodiment of the present invention.

Turning now to FIG. 1, a diagrammatic perspective view of an exemplary spray valve assembly 100 is shown, in accordance with an embodiment of the present invention. In the embodiment illustrated in FIG. 1, the spray valve assembly ("assembly") 100 includes a first flow valve 115, a second flow valve 120, and a spray valve 125. The flow valves 115 and 120 are operably coupled to the spray valve 125 such that the flow of one or more liquids to the spray valve 125 is metered by the flow valves 115 and 120. For example, the first flow valve 115 is equipped to selectively direct a first fluid (e.g., adhesive) to a first inlet of the spray valve 125 (during a first phase of a spray cycle), while the second flow valve 120 is equipped to selectively direct a second fluid (e.g., water) to a second inlet of the spray valve 125 (during a second phase of the spray cycle). The spray cycle will be discussed more fully below with reference to FIG. 4.

In an exemplary embodiment, the spray valve 125 may be configured as a pulse width modulated (PWM) spray gun that includes a nozzle 135 for dispersing an atomized or non-atomized stream 130 of the first fluid or the second fluid. Generally, the PWM spray gun is able to govern a rate of flow of the fluid being dispersed within the stream 130 by switching an electrically actuated plunger within the spray valve 125 on and off very quickly. Further, the flow rate may be precisely controlled by varying the time of dispersion of the fluid based on a frequency and a duty cycle. For example, the frequency may range between 0 and 10,000 cycles per minute while, at the same time, holding a constant pressure (e.g., 40 psi of pressure) within the spray valve 125. In addition, a duty cycle may be set in terms of percentage. For instance, a duty cycle of 50% produces a flow rate that is half the maximum flow for the nozzle 135. Duty cycles may range from less than 5% to 100% of total flow, thus, providing precise flow control.

Because the PWM spray gun allows for adjustable flow, the spray valve 125 affords the user nearly instantaneous flow adjustment for production line changes. Other features of the spray valve 125 when configured as a PWM spray gun include reduced misting (improved transfer efficiency that eliminates atomizing air to save energy) and consistent spray pattern (e.g., evenly distributes the adhesive over the sprat pattern).

Although typically configured as a PWM spray gun or any other non-atomizing-fluid pressure spray gun, the spray valve 125 may still have an infrequent tendency to develop clogs in the nozzle 135. Accordingly, a spray cycle is employed to further reduce the likelihood of clogs. The "spray cycle" generally represents a series of operations that manage flow of two or more fluids to the spray valve 125 using flow valves 115 and 120. In an exemplary embodiment, the operations of the spray cycle may include shutting off the flow of adhesive from the first line by triggering the first flow valve 115 and, simultaneously or shortly thereafter, commencing flow of clean-out fluid from the second line by triggering the second flow valve 120. This introduction of the clean-out fluid into the spray valve 125 is shown to minimize the potential for clogging in the nozzle 135. Further, the prescribed amount of clean-out fluid (e.g., small proportion of total fluid being sprayed from the nozzle 135) introduced to the spray valve 125 is shown to create negligible negative impact on the application and effectiveness of the adhesive to an article that receives the adhesive.

Figure 2:
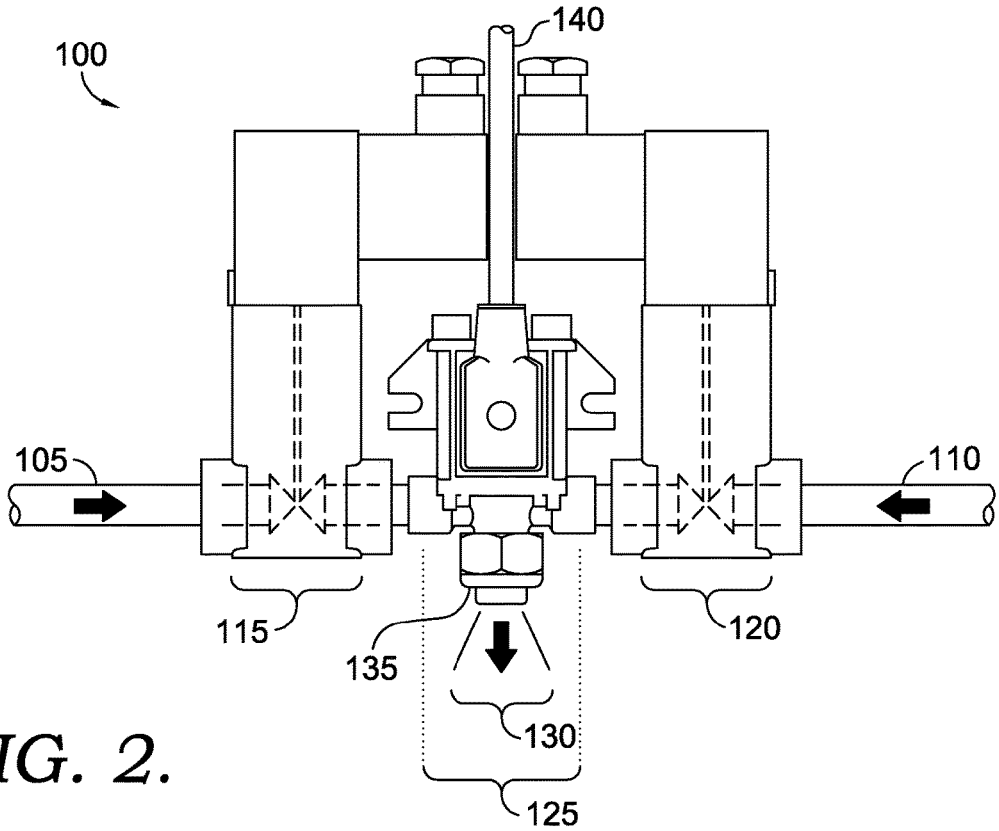
FIG. 2 is a diagrammatic elevation view that exposes flow pathways within a first and a second flow valve of the spray valve assembly, in accordance with an embodiment of the present invention.
Figure 4:
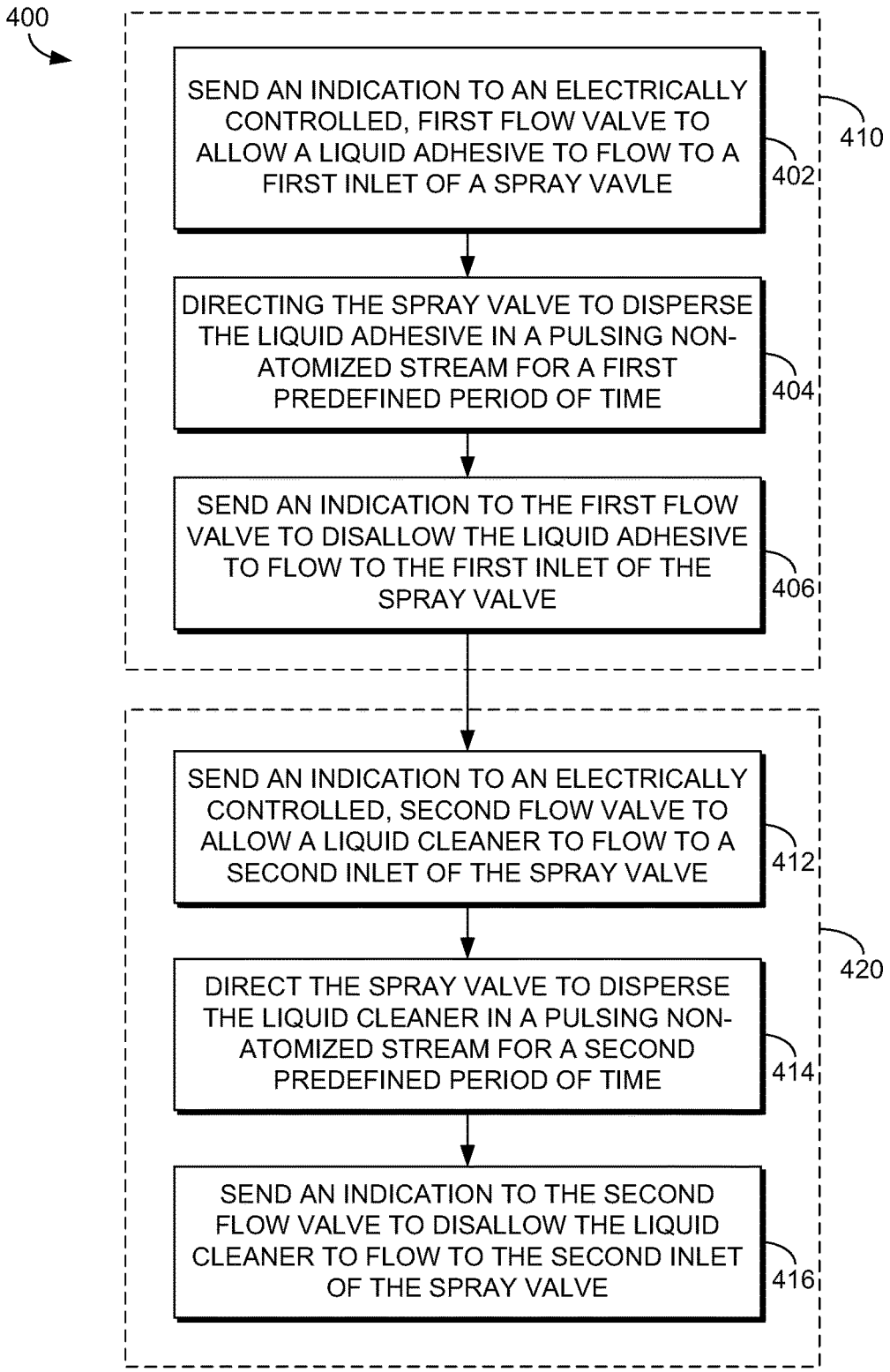
FIG. 4 is a flow diagram illustrating an overall method for controlling valves independently within the spray valve assembly, in accordance with an embodiment of the present invention.

The spray cycle will now be described with reference to FIGS. 2 and 4. In particular, FIG. 2. is a diagrammatic elevation view that exposes flow pathways within the first flow valve 115 and the second flow valve 120 of the assembly 100, while FIG. 4 is a flow diagram illustrating an overall method 400 for controlling the valves 115, 120, and 125 independently within the assembly 100, in accordance with embodiments of the present invention. Although the terms "step" and "block" are used hereinbelow to suggest different elements of methods employed, the terms should not be interpreted as implying any particular order among or between various steps herein disclosed unless and except when the order of individual steps is explicitly described.

Typically, the spray cycle may be divided into two or more phases for accomplishing dispersion of the first and second fluids, respectively, from the assembly 100. For the purpose of explanation of the spray cycle, a first phase 410 and a second phase 420 will be described herein. However, it should be appreciated and understood that the spray cycle may be divided into any number of discrete phases.

Initially, the method 400 of the spray cycle involves sending an indication to the first flow valve 115 to allow a first fluid (e.g., liquid adhesive) to flow to a first inlet of the spray valve 125, as depicted at block 402. As indicated by the dashed lines within the assembly 100 of FIG. 2, the flow valves 115 and 120 may be designed to be electrically controlled such that the rate of flow, or prevention of flow, to the spray valve 125 may be governed electronically and/or automatically. Or, in another embodiment not shown, the flow valves 115 and 120 may be configured as manually operated valves (e.g., ball valves) that are opened and closed by an operator assigned to the station with the assembly 100 on the manufacturing line.

Next, the spray valve 125 may be directed to disperse the first fluid in a stream 130 from the nozzle 135 for a first predefined period of time, as depicted at block 404. In one instance, directing the spray valve 125 to disperse the first fluid includes controlling the spray valve 125 with electronic signals generated according to a first duty cycle and a first frequency. Typically, the first duty cycle in cooperation with the first frequency govern a flow rate of the first fluid through the spray valve 125 over the first predefined period of time.

As depicted at block 406, an indication is sent to the first flow valve 115 to disallow the first fluid from flowing to the first inlet of the spray valve 125. Disallowing the flow of the first fluid may involve electronically causing the first flow valve 115 to close a pathway between a source of the adhesive liquid and the spray valve 125. These steps in blocks 402-406, among other steps, are contemplated by one embodiment of the present invention as occurring during the first phase 410 of the spray cycle.

Blocks 412-416 included within the second phase 420 of the spray cycle will now be discussed. It should be appreciated and understood that, similar to the first phase 410 of the spray cycle, the second phase 420 of the spray cycle may include any number of steps, including some steps that are not indicated in the method 400 of FIG. 4. Initially, during the second phase 420 of the spray cycle, an indication is sent to the second flow valve 120 to allow a second fluid (e.g., liquid cleaner, hydrogen peroxide, or water) to flow to a second inlet of the spray valve 125, as depicted at block 412. As mentioned above, the second flow valve 120, similar to the first flow valve 115, may be configured to be manually or automatically controlled. An example of automated control involves configuring the second flow valve 120 as an automated solenoid valve that may be either on/off or incrementally adjustable with respect to flow of the second fluid. Automated control may further involve electronically coupling the second flow valve 120 to a processing unit with logic running thereon, wherein the logic is capable of accessing/maintaining and executing the spray cycle.

As depicted at block 414 within the second phase 420 of the spray cycle of the method 400, the spray valve 125 is directed to disperse the second fluid in a stream for a second predefined period of time. Typically, the first predefined period of time is considerably greater in duration than the second predefined period of time. For example, the electronically controlled, second flow valve 120 (positioned upstream of the spray valve 125) may be automatically controlled to send a short burst (e.g., approximately a quarter of a second) of the second fluid to the spray valve 125, where the second fluid passes through the nozzle 125 each time the flow of the first fluid is completed to keep the nozzle 135 clear of blockages (e.g., hardened glue). In other words, the second fluid is formulated to rinse residue of the first fluid (e.g., liquid adhesive) from an internal passageway of a nozzle 135 of the spray valve 125. Accordingly, the second fluid may represent any liquid that functions to assist in washing an adhesive from a surface. In one instance, the second fluid may be a water-based cleaner or simply water itself. In another instance, the second fluid may be a cleaner with an additive (e.g., lubricant) that assists in another functionality (e.g., lubricating the valves) besides just washing an adhesive from a surface.

In one instance, directing the spray valve 125 to disperse the second fluid in a stream includes controlling the spray valve 125 with electronic signals generated according to a second duty cycle and a second frequency. Typically, the second duty cycle in cooperation within the second frequency governs a flow rate of the second fluid through the spray valve 125 over the second predefined period of time. As depicted at block 416, an indication is sent to the second flow valve 120 to disallow the second fluid from flowing to the second inlet of the spray valve 125. Disallowing the flow of the second fluid may involve electronically causing the second flow valve 120 to close a pathway between a source of the cleaner liquid and the spray valve 125.

It should be appreciated and understood that the ordering of the steps of the method 400 may vary from the ordering of the blocks 402-406 and 412-416 shown in FIG. 4. For instance, the spray valve 125 may be electronically controlled to disperse the liquid adhesive as a non-atomized stream simultaneously with or before directing the first flow valve 115 to allow the first fluid to flow to the spray valve. Further, it should be appreciated and understood that the first and second phases are not necessarily separate, but may overlap in some steps. For instance, the indication to electronically control the second flow valve 120 (phase two) may be sent prior to sending the indication to electronically control the first flow valve 115 (phase one).

Figure 3:
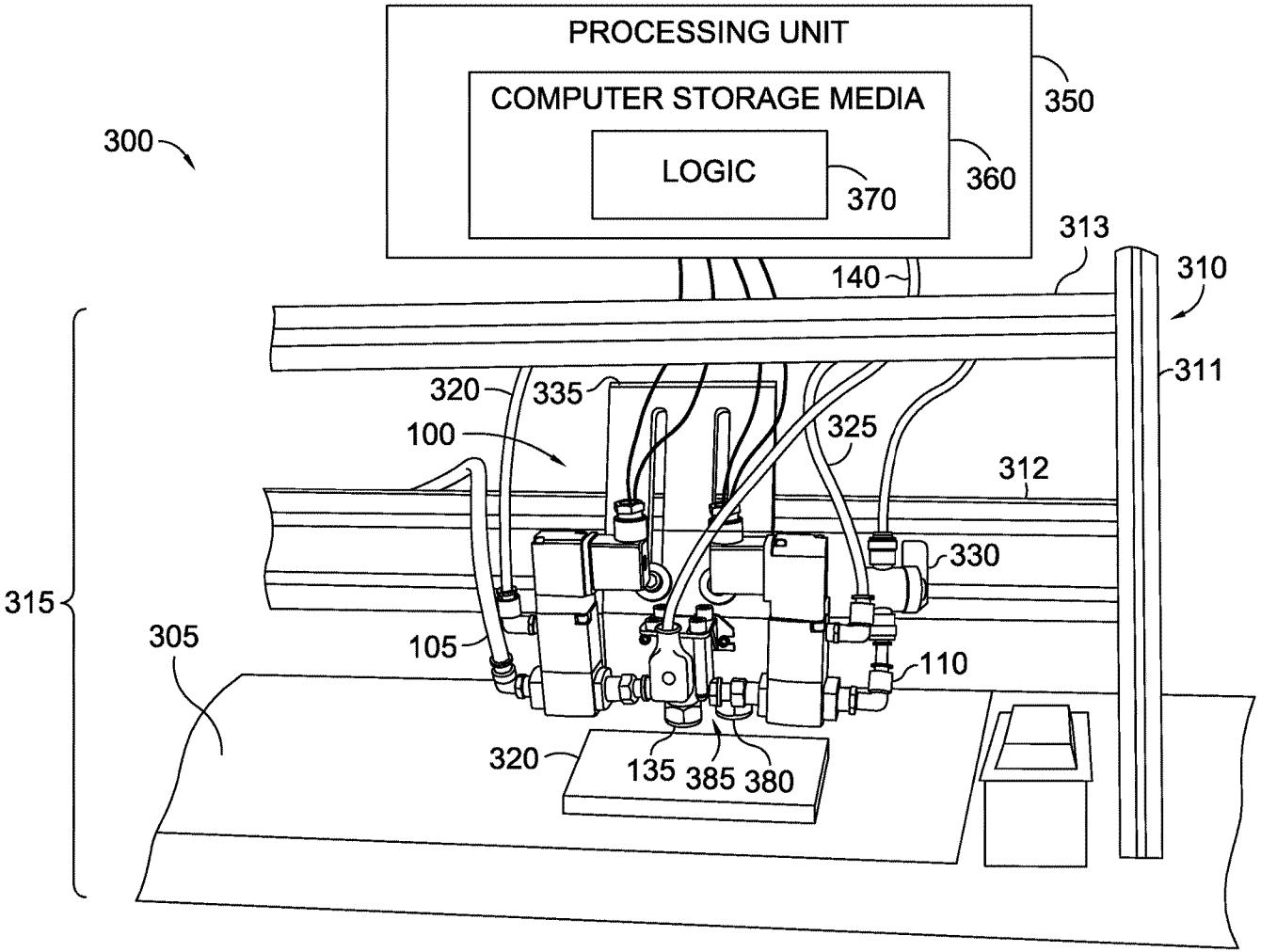
FIG. 3 is a diagrammatic perspective view of the spray valve assembly installed within a station of an assembly line, in accordance with an embodiment of the present invention.

Referring now to FIG. 3, a diagrammatic perspective view of the assembly 100 installed within a station 315 of an exemplary assembly line 300 is shown, in accordance with an embodiment of the present invention. The station 315 may include a rack 310 and a platform 305 for holding an article 320 that is ready to receive liquid adhesive from the assembly 100. The rack may include at least one substantially vertical member 311 and one or more substantially horizontal members 312 and 313. The assembly 100 may be mounted to one or more of the members 311-313 such that it is adjustable in position and orientation within the station 315. As illustrated, the assembly 100 is fixedly attached to the horizontal member 312 in a manner that allows the nozzle 135 to direct its stream downward at the platform 305 underlying the article 320. It should be noted that, although described as a downward stream, the stream may be directed in any direction or combination of directions, such as upward, sideways, forward, or rearward.

Further, the station 315 includes distribution lines that interconnect the valves 115, 120, and 125 of the assembly 100 to sources of fluid and/or pressurized air. For instance, the lines 105 and 110 may be connected to supply containers of liquid adhesive and liquid cleaner, respectively, while the lines 320 and 325 may be connected to pneumatic pump(s) for producing and distributing pressurized air to the flow valves 115 and 120, respectively. One or more of the lines 105, 110, 320, and 325 may be equipped with an intermediate valve, such as manually operated ball valve 330, for opening and closing the flow of fluid and/or air to the assembly 100. In one instance of operation, the intermediate valve(s) may be manually adjusted to override the automated control of the flow valves 115 and 120.

The assembly line 300 may further include a computing device with a processing unit 350 for electronically controlling the valves 115, 120 and 125 of the assembly 100. The processing unit 350 may be located locally at the station 315 or in a remote centralized location. Or, although shown as one item, the processing unit 350 may be configured as multiple discrete units that are individually coupled to respective valves of the assembly 100. The coupling between the respective valves and the processing unit 350 may be made by wire or wirelessly. For example, the coupling between the spray valve 125 and the processing unit 350 may be made by an electrical connection 140 that conveys power and electronic signals to the spray valve 125.

In an exemplary embodiment, the assembly 100 includes a second spray valve 385 (positioned behind the spray valve 125 in FIG. 3). As with the spray valve 125, the second spray valve 385 may be configured as a PWM spray gun, a non-atomizing spray gun, an atomizing spray gun, any other type of spray valve known in the relevant field, or any combination thereof. The first spray valve 125 and second spray valve 385 may be configured similarly or differently. Further, the second spray valve may be configured for dispersing a stream from its nozzle 380.

In an exemplary embodiment, the second spray valve 385 is configured to receive and disperse a third fluid. Typically, the third fluid is dispersed during the first phase of the spray cycle and not during the second phase of the spray cycle. As mentioned above, the first fluid represents a liquid adhesive (first phase) and the second fluid represents a liquid cleaner (second phase), where the liquid cleaner is formulated to rinse residue of the liquid adhesive from an internal passageway of the nozzle 135 of the spray valve 125. The third fluid dispersed by the second spray valve 385, if the assembly 100 is so equipped, may include a liquid activator. In operation, the liquid activator, when mixed with the liquid adhesive, forms a glue. The mixing may occur on a surface of the article 320 or in the air-space prior to reaching the article 320. For example, as shown in FIG. 3, the spray valve 125 and the second spray valve 385 are arranged such that the first fluid dispersed from the nozzle 135 of the spray valve 125 is mixed with the third fluid dispersed from the nozzle 380 of the second spray valve 385 in the air-space before contacting a surface of the underlying article 320 on the platform 305.

In embodiments, the arrangement of the spray valves 125 and 385 may involve positioning and orientating the nozzles 135 and 380 of the spray valves 125 and 385, respectively, such that first and third fluids mix at a predetermined location during the first phase of the spray cycle. In one instance, the first and second spray valves 125 and 385 may be positioned proximately such that the non-atomized stream of the first fluid from the spray valve 125 intersects with the non-atomized stream of the third fluid from the second spray valve 385 before contacting the article 320 positioned beneath spray valves 125 and 385. In this instance, the spray valves 125 and 385 may be aimed in a substantially parallel alignment to achieve mixing when positioned proximately (e.g., installed to the rack 310 back-to-back as shown in FIG. 3). In another instance, the first and second spray valves 125 and 385 may be orientated in an angular bias (e.g., ranging from 0 to 45 degrees) such that the non-atomized stream of the first fluid from the spray valve 125 intersects with the non-atomized stream of the third fluid from the second spray valve 385 before contacting the article 320 positioned beneath spray valves 125 and 385. In this instance, the spray valves 125 and 385 may be positioned in a non-adjacent position to achieve mixing when aimed toward each other (e.g., orientated with respect to another on the rack 310 to form a 30 degree trajectory between the direction of the nozzles 135 and 380 as shown in FIG. 3).

In this way, embodiments of the invention contemplate single and/or separately aimed streams of adhesive and activator fluid to meet at or before the article 320 (e.g., cloth or foam panel) to be fastened. Thus, the adhesive fluid may be formulated to adhere to the article 320 after mixing with the activator fluid, but not adhere to the internal passage of the nozzle 135 when being dispersed from the spray valve 125. That is, the adhesive fluid does not take on the properties of a glue until mixed with the activator fluid. Further, this technique of using two spray valves 125 and 385 allows for tightly controlling and adjusting the amount of activator fluid being injected into the non-atomized stream of adhesive fluid, as well as controlling the amount of mixed glue deposited on the article 320 passing beneath the streams.

As mentioned above with respect to FIG. 3, component(s) of the assembly 100 are illustrated as being operably coupled to the processing unit 350. For example, the spray valve 125 is operably coupled to the processing unit 350 via a cable 140 that communicates command signals for controlling the non-atomized stream of the spray valve 125 as well as providing power thereto. Although shown as a wired connection, embodiments of the present invention contemplate wireless connections between the assembly 100 and the processing unit 350 as well. Further, although not shown, embodiments of the present invention contemplate components of the assembly 100 that are not spray or flow valves being operably coupled to the processing unit 350. For example, sensors within the assembly 100 or installed in the station 315 may be connected in communication with the processing unit to provide feedback with respect to, inter alia, amount/ratio of dispersions from the nozzles 135 and 380, misting being generated by the non-atomizing streams, and coverage of glue on a surface of the article 320.

Generally, the processing unit 350 is configured to interpret the input and generate an output, based on predefined logic 370, that manages operation of the valves 115, 120, 125, and 385 of the assembly 100. In embodiments, the processing unit 350 may be a personal computer, desktop computer, laptop computer, consumer electronic device, handheld device (e.g., personal digital assistant), various servers, processing equipment, and the like. It should be noted, however, that the invention is not limited to implementation on such computing devices but may be implemented on any of a variety of different types of computing devices within the scope of embodiments of the present invention.

Typically, the processing unit 350 represents some form of computing unit (e.g., central processing unit, microprocessor, etc.). As utilized herein, the phrase "computing unit" generally refers to a dedicated computing device with processing power and storage memory, which supports operating software that underlies the execution of software, applications, and computer programs thereon. In one instance, the computing unit is configured with tangible hardware elements, or machines, that are integral, or operably coupled, to the processing unit 350 to enable performance of communication-related processes and other operations. In another instance, the computing unit may encompass a processor (not shown) coupled to the computer-storage media 360 accommodated by the processing unit 350.

Generally, the computer-storage medium 360 includes physical memory that stores, at least temporarily, a plurality of computer software components (e.g., logic, the duty cycle, and the spray cycle) that are executable by the processor. As utilized herein, the term "processor" is not meant to be limiting and may encompass any elements of the computing unit that act in a computational capacity. In such capacity, the processor may be configured as a tangible article that processes instructions. In an exemplary embodiment, processing may involve fetching, decoding/interpreting, executing, and writing back instructions. Thus, the processing unit 350 serves as an intelligent machine that instructs the assembly 100 to operate according to methods described above.

Although not shown, the processing unit 350 may include touch-activated controls for receiving manually providing input into the logic 370. The touch-activated controls may be configured as any mechanism or an element known in the relevant field of technology that is configured to receive a user-initiated input and generate command signals that may be sensed by component(s) of the assembly 100. Further, the processing unit 350 may be coupled to a UI display for providing the operator of the station 315 a visual indication of the status of the functional qualities of the assembly 100.

It should be understood that the construction of the assembly 100 lends itself to enable the spray valves 125 and 385 to be easily installed to the remaining components of the assembly 100 as well as to be easily arranged (position and orientation) with respect to each other. In one instance, the nature of the rack 310 allows for use of quick-disconnect hardware to achieve rapid disconnection of components during or rapid connection during setup. Further, it should be understood and appreciated that the assembly 100 may be located within a traditional manufacturing line, or may be employed in any other environment in which the attributes of the assembly 100 may be considered useful. Examples of such environments comprise both commercial and industrial settings.

Although various configurations of the assembly 100 have been described, it should be understood and appreciated that other types of suitable devices and/or valves that serve to control flow or control dispersion of a fluid be used, and that embodiments of the present invention are not limited to the valves 115, 120, 125, and 385 described herein. For instance, embodiments of the present invention may include systems that include a single 3-position, 2-way valve that receives both the first fluid and the second fluid and, based on the logic 370, controls which of the fluids enters an entry port of the spray valve 125. Accordingly, it should be understood that the illustrated embodiments of the assembly 100, described herein, are not meant to be limiting and may encompass any other suitable configuration and accompanying devices known to those in the furniture-manufacturing industry that accomplish the goals of this invention.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed:

1. A spray valve assembly comprising:

a spray valve comprising a nozzle that selectively disperses a stream of a first fluid or a second fluid during a plurality of phases of a spray cycle, a first inlet, and a second inlet;

a first flow valve that selectively directs the first fluid to the first inlet of the spray valve during a first phase of the plurality of phases of the spray cycle, the first fluid being a liquid adhesive that joins two or more articles together, said first phase comprising dispensing the first fluid from the spray valve for a first duration; and a second flow valve that selectively directs the second fluid to the second inlet of the spray valve during a second phase of the plurality of phases of the spray cycle, wherein the first phase precedes the second phase while the second phase does not overlap the first phase in duration, the second fluid being a liquid cleaner that flushes deposits of the liquid adhesive from an internal passageway of the spray valve and expels the deposits from the spray valve, said second phase comprising dispensing the second fluid from the spray valve for a second duration, wherein the second duration is different that the first duration and the second fluid is different than the first fluid, wherein a stream of the liquid adhesive is directed to exit the nozzle during the first duration and contact an article positioned beneath the nozzle of the spray valve, and a stream of the liquid cleaner is directed to exit the nozzle during the second duration and contact the article without changing an adhesiveness of the liquid adhesive previously applied to the article during the first duration, further wherein the first flow valve selectively directs the first fluid to the first inlet of the spray valve during a third phase of the plurality of phases of the spray cycle, said third phase comprising dispensing the first fluid from the spray valve for the first duration.

2. The spray valve assembly of claim 1, wherein the liquid cleaner is functional to rinse residue of the liquid adhesive from an internal passageway of the nozzle of the spray valve.

3. The spray valve assembly of claim 1, wherein the first phase of the spray cycle involves electrically controlling the first flow valve to allow the liquid adhesive to flow to the first inlet of the spray valve and, after a first predefined period of time, electrically controlling the first flow valve to disallow the liquid adhesive to flow to the first inlet of the spray valve.

4. The spray valve assembly of claim 3, wherein the second phase of the spray cycle involves electrically controlling the second flow valve to allow the liquid cleaner to flow to the second inlet of the spray valve and, after a second predefined period of time, electrically controlling the second flow valve to disallow the liquid adhesive to flow to the second inlet of the spray valve.

5. The spray valve assembly of claim 4, wherein the first predefined period of time is greater in duration than the second predefined period of time.

6. The spray valve assembly of claim 1, wherein the spray valve is a pulse width modulated (PWM) spray gun that is automatically controlled via logic embodied on a processer.

7. The spray valve assembly of claim 1, wherein the spray valve is configured to be electrically controlled by a processor.

8. The spray valve assembly of claim 1, wherein the first flow valve and the second flow valve are upstream of the spray valve.

9. A system for applying a liquid adhesive using a spray valve assembly, the system comprising:

a supply of liquid adhesive for joining two or more articles together;

a supply of liquid cleaner for removing deposits of the liquid adhesive from internal passageways of a spray valve assembly;

a spray valve assembly for selectively emitting the liquid adhesive or the liquid cleaner from a nozzle during a plurality of phases of a spray cycle, comprising:

a first flow valve that controls the flow of liquid adhesive from the supply of liquid adhesive into the spray valve assembly during a first phase of the plurality of phases of the spray cycle;

a second flow valve that controls the flow of liquid cleaner from the supply of liquid cleaner into the spray valve assembly during a second phase of the plurality of phases of the spray cycle; and a spray valve that emits the liquid adhesive for a first duration or the liquid cleaner for a second duration onto an article positioned beneath the nozzle, a first inlet for receiving the liquid adhesive dispensed from the first flow valve during the first phase, and a second inlet for receiving the liquid cleaner dispensed from the second flow valve during the second phase, the nozzle configured for emitting the liquid adhesive or the liquid cleaner onto an article positioned beneath the nozzle, the liquid cleaner not changing the adhesiveness of the liquid adhesive previously applied to the article; and a processor configured to send electrical signals to one of the first flow valve and the second flow valve, wherein the electrical signals cause the respective flow valve to open or close, further wherein the first flow valve selectively directs the first fluid to the first inlet of the spray valve during a third phase of the plurality of phases of the spray cycle, said third phase comprising emitting the first fluid from the spray valve for the first duration.

10. The system of claim 9, wherein the spray valve is operated based upon electrical signals sent by the processor, and further wherein the processor is configured to send electrical signals to the spray valve.

* * * * *